US008727504B2

(12) United States Patent
Palmieri

(10) Patent No.: US 8,727,504 B2
(45) Date of Patent: May 20, 2014

(54) MICROFLUIDIC JETTING DEVICE WITH PIEZOELECTRIC ACTUATOR AND METHOD FOR MAKING THE SAME

(75) Inventor: Michele Palmieri, Corvallis, OR (US)

(73) Assignee: STMicroelectronics, Inc., Coppell, TX (US)

( * ) Notice: Subject to any disclaimer, the term of this patent is extended or adjusted under 35 U.S.C. 154(b) by 17 days.

(21) Appl. No.: 13/294,956

(22) Filed: Nov. 11, 2011

(65) Prior Publication Data

US 2013/0120506 A1 May 16, 2013

(51) Int. Cl.
*B41J 2/015* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 6,294,860 | B1 | 9/2001 | Shimada et al. | 310/328 |
| 6,673,593 | B2 | 1/2004 | Mastromatteo et al. | 435/283.1 |
| 6,693,039 | B2 | 2/2004 | Erratico et al. | 438/700 |
| 6,770,471 | B2 | 8/2004 | Barlocchi et al. | 435/287.2 |
| 6,862,783 | B2 * | 3/2005 | Nishikawa et al. | 29/25.35 |
| 7,144,099 | B2 * | 12/2006 | Cabal et al. | 347/54 |
| 7,678,600 | B2 | 3/2010 | Villa et al. | 438/48 |
| 7,705,416 | B2 | 4/2010 | Barlocchi et al. | 257/510 |
| 7,754,578 | B2 | 7/2010 | Villa et al. | 438/422 |
| 7,811,848 | B2 | 10/2010 | Barlocchi et al. | 438/52 |

FOREIGN PATENT DOCUMENTS

| | | |
|---|---|---|
| JP | 2003-133604 A | 5/2003 |
| JP | 2010-287268 A | 12/2010 |

* cited by examiner

*Primary Examiner* — Matthew Luu
*Assistant Examiner* — Erica Lin
(74) *Attorney, Agent, or Firm* — Seed IP Law Group PLLC

(57) ABSTRACT

Disclosed herein is a microfluidic jetting device having a piezoelectric member positioned above a displaceable membrane. A voltage is applied across the piezoelectric member causing deformation of the piezoelectric member. The deformation of the piezoelectric member results in a displacement of the membrane, which is formed above a cavity. Displacement of the membrane creates pressure to jet or eject liquid from the cavity and suction liquid into the cavity through ports or apertures formed in the in membrane.

13 Claims, 14 Drawing Sheets

MICROFLUIDIC JETTING DEVICE WITH PIEZOELECTRIC ACTUATOR AND METHOD FOR MAKING THE SAME

BACKGROUND

1. Technical Field

The present disclosure generally relates to a piezoelectrically actuated microfluidic jetting device.

2. Description of the Related Art

Piezoelectric materials are useful for actuating electromechanical devices. Piezoelectric materials are those that exhibit both a piezoelectric effect and a reverse piezoelectric effect. The piezoelectric effect is the generation of a voltage across opposite faces of a piezoelectric material in response to applying pressure to the piezoelectric material. The reverse piezoelectric effect is the contraction, expansion, or otherwise deformation of a piezoelectric material in response to applying an electric field across the piezoelectric material. Some approaches to jetting ink utilize the reverse piezoelectric effect for actuation.

U.S. Pat. No. 6,294,860 (hereinafter '860 patent) describes an ink jet recording device equipped with a piezoelectric film element. The recording device includes a vibrating plate with a piezoelectric film placed over an ink reservoir formed in a first substrate. The vibrating plate creates pressure within the ink reservoir causing ink to eject from the ink reservoir. The ink reservoir is formed by entirely removing a portion of the first substrate located beneath the piezoelectric film. Ink is ejected from the ink reservoir through an ink jetting nozzle formed in a second substrate that is bonded to a lower surface of the first substrate so that the nozzle jets ink in a direction that is away from the piezoelectric film.

Japanese publication JP2003133604 describes an ink jet recording device that is similar to '860 patent with the exception that a nozzle is formed in a plate that is thinner than the second substrate of the '860 patent, however, similar to the '860 patent the thin plate is bonded to the bottom of the first substrate.

The existing approaches appear to be limited to jetting ink in a direction that is away from the piezoelectric element out of an ink reservoir that extends completely through a substrate.

BRIEF SUMMARY

The techniques of the herein disclosed embodiments of the invention are directed towards a microfluidic jetting device having a cavity formed in but not completely through a substrate. The jetting device also has a piezoelectrically displaceable membrane through which an inlet port opening and an outlet port opening are formed. The displaceable membrane is a composition of dielectrics, a composition of monocrystalline silicon ("monosilicon") and dielectrics, a composition of epitaxially grown polysilicon ("epipoly") and dielectrics, a uniform piece of monosilicon, or a uniform layer of epipoly according to several embodiments of the invention. Piezoelectric displacement of the membrane pressurizes liquid contained in the cavity, causing a portion of the liquid to eject from the cavity through the outlet port opening. Piezoelectric displacement of the membrane also creates suction in the cavity, causing liquid to be drawn into the cavity through the inlet port opening.

Advantageously, positioning the inlet port opening and the outlet port opening in the membrane results in a less costly jetting device because both the inlet port opening and the outlet port opening are openable using the same manufacturing process step. Additionally, utilizing a cavity that does not pass entirely through the substrate eliminates the several process steps needed to protect the active side of a wafer for a back side etched used to make a cavity that passes entirely through a substrate. Furthermore, the presently disclosed embodiments of the invention enable orienting the piezoelectric actuator in the same direction of liquid ejection, which cannot be done with the approaches of the prior art.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles, and some of the elements are enlarged and positioned to improve understanding of the inventive features

DETAILED DESCRIPTION

In the description provided herewith, certain specific details are set forth in order to provide a thorough understanding of various disclosed embodiments. However, one skilled in the relevant art will recognize that embodiments may be practiced without one or more of these specific details, or with other methods, components, etc. In some instances, well-known structures or processes associated with fabrication of MEMS have not been shown or described in detail to avoid unnecessarily obscuring descriptions of the inventive embodiments.

Unless the context requires otherwise, throughout the specification and claims that follow, the words "comprise" and "include" and variations thereof, such as "comprises," "comprising," and "including," are to be construed in an open, inclusive sense, that is, as meaning "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

As used in the specification and appended claims, the use of "correspond," "corresponds," and "corresponding" is intended to describe a ratio of or a similarity between referenced objects. The use of "correspond" or one of its forms should not be construed to mean the exact shape or size.

Figure 1:
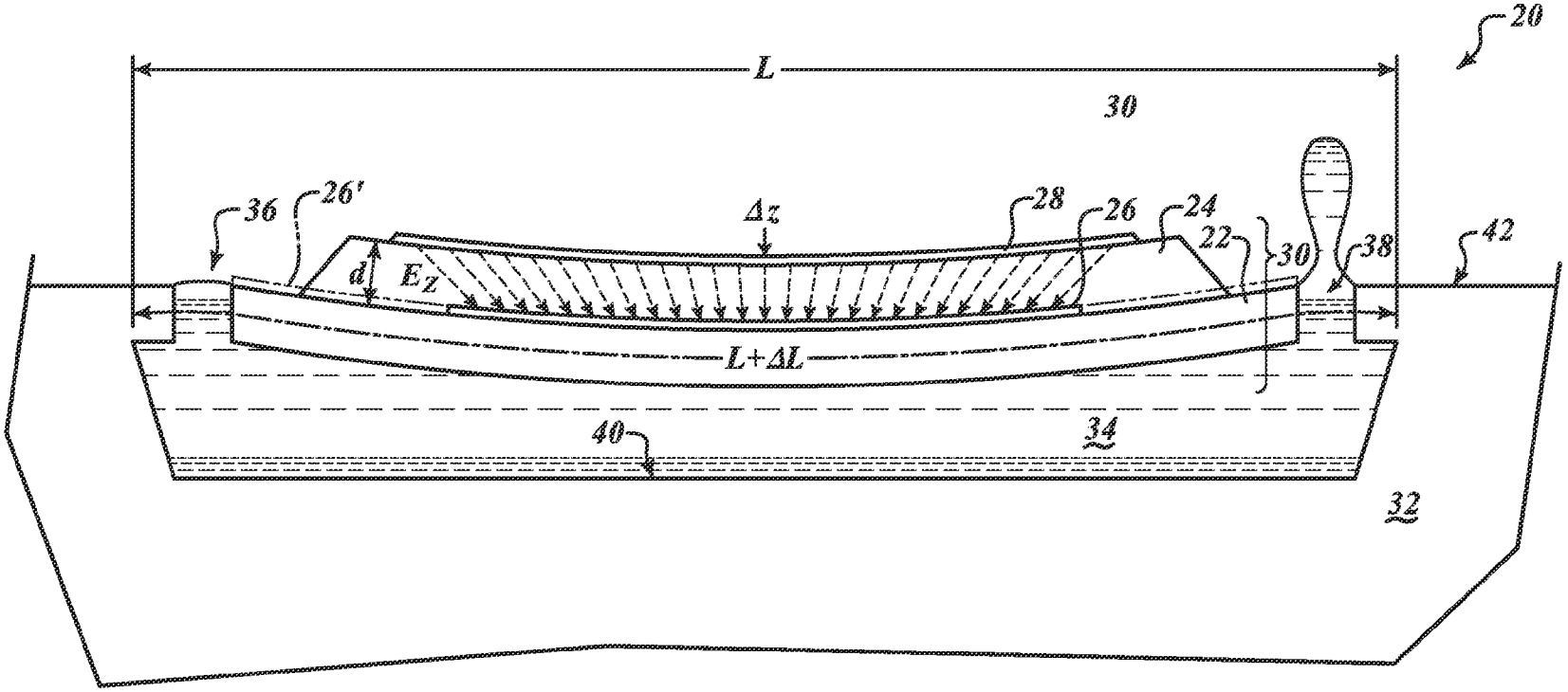
FIG. 1 is a schematic cross-sectional view of an actuated microfluidic jetting device, according to an embodiment of the invention.

FIG. 1 is a schematic cross-section illustrating a microfluidic jetting device 20, according to one embodiment of the invention. The microfluidic jetting device 20 includes a membrane 22, a piezoelectric element 24, a bottom electrode 26, and a top electrode 28, which together constitute an actuator 30. The microfluidic jetting device 20 also includes a substrate 32, a cavity 34, an inlet port 36, and an outlet port 38.

The membrane 22 is positioned above the cavity 34 and is configured to express, namely to expel, displace, or eject a volume of liquid from the cavity 34, according to one embodiment of the invention. The membrane 22 may be formed using one of various techniques that will be described in detail in connection with FIGS. 2-15. According to one embodiment, the membrane 22 includes a plurality of silicon dioxide fingers surrounded by silicon nitride. According to another embodiment, the membrane 22 also includes a layer of polycrystalline silicon ("polysilicon"). According to another embodiment, the membrane 22 is shaped and grown from monocrystalline silicon ("monosilicon").

The piezoelectric element 24 is positioned above the membrane 22 and is configured to displace the membrane 22 through a counter or reverse piezoelectric effect, according to one embodiment. Piezoelectric materials generate charge when subject to pressure or stress. Such materials are commonly used in applications for weight or pressure measurements as well as for spark or fire ignition. The piezoelectric effect is a reversible process, so under the reverse piezoelectric effect, piezoelectric materials tend to constrict, expand, or deflect when subject to an external electric field. An example of a piezoelectric material is PZT (lead zirconate titante). PZT is a ceramic perovskite material. Other examples of piezoelectric materials include crystals such as gallium orthophosphate and ceramics such as barium titanate, lead titanate, and lithium niobate. According to one embodiment, the piezoelectric element 24 is PZT. According to other embodiments, the piezoelectric element 24 is one of gallium orthophosphate, barium titanate, lead titanate, lithium niobate, and the like.

A lower electrode 26 and an upper electrode 28 are disposed below and above the piezoelectric element 24, respectively. The lower and upper electrodes 26, 28 are conductive films or layers electrically coupled to receive electrical signals and generate an electric field $E_z$ across a thickness d of the piezoelectric element 24. The strength of the electric field $E_z$ applied to the piezoelectric element 24 is directly proportional to the voltage of the signal applied and indirectly proportional to the thickness d of the piezoelectric element 24. The applied electric field is expressed as $E_Z=V/d$, according to one embodiment of the invention.

The inlet port 36 extends through the membrane 22 on a side of the piezoelectric element 24 that is opposite to the outlet port 38, according to one embodiment of the invention. The inlet port 36 is an aperture that is opened through the membrane 22 adjacent to the piezoelectric element 24 and is configured as a fluidic constrictor. According to one embodiment, the inlet port 36 is a polygonal-shaped aperture. According to another embodiment, the inlet port 36 is a henagonal-shaped aperture. The inlet port 36 unidirectionally permits fluid to flow into the cavity 34 while substantially preventing fluid from flowing out of the cavity 34. The cavity 34 is filled with liquid through the inlet port 36 by capillary force or other fluidic forces such as suction, according to one embodiment of the invention.

The outlet port 38 extends through the membrane 22 on a side of the piezoelectric element 24 that is opposite to the inlet port 36, according to one embodiment of the invention. The outlet port 38 is an aperture that is opened through the membrane 22 adjacent to the piezoelectric element 24 and is configured as a nozzle or orifice to expel a volume of fluid from the cavity 34. The shape and size of the perimeter of the outlet port 38 enable the selective and unidirectional expression of fluid from the cavity 34. As a result of the shape and size of the outlet port 38, a surface tension of the liquid prevents the liquid held in the cavity 34 from undesirably discharging through the outlet port 38. According to one embodiment, the outlet port 38 is a polygonal-shaped aperture. According to another embodiment, the outlet port 38 is a henagonal-shaped aperture. The outlet port 38 is an opening having a smaller area than the opening of the inlet port 36 according to one embodiment of the invention.

The inlet port 36 is opened in one of several locations in the membrane 22 with reference to the outlet port 38, according to several embodiments of the invention. The inlet port 36 is opened on the same side of the piezoelectric element 24 as the outlet port 38, according to one embodiment. The inlet port 36 is opened on a side of the piezoelectric element 24 that is adjacent to the side of the piezoelectric element 24 next to which the outlet port 38 is opened, according to another embodiment. The inlet port 36 is opened proximate to a first corner of the piezoelectric element 24 and the outlet port 38 is opened proximate to a second corner of the piezoelectric element 24 that is different from the first corner, according to another embodiment. The piezoelectric element 24 is henagonal and the inlet port 36 is positioned from 90 degrees to 180 degrees away from the outlet port 38 around a perimeter of the piezoelectric element 24, according to another embodiment.

The actuator 30, the inlet port 36, and the outlet port 38 are manufactured above the cavity 34, according to one embodiment of the invention. The cavity 34 is formed in a substrate 32 that is monosilicon. As will be discussed in further detail below, the cavity 34 is opened by isotropically etching silicon away from the area below the actuator 30. According to another embodiment, the illustrated substrate 32 is polysilicon that has been deposited above one or more circuits manufactured using semiconductor processes.

In operation, the actuator 30 displaces by deflecting into and out of the cavity 34 in response to electrical signals, such as voltages, being applied across the lower and upper electrodes 26, 28. According to another embodiment, the actuator 30 undulates or moves with a wavelike motion into and out of the cavity 34 in response to electrical signals being applied across the lower and upper electrodes 26, 28, and the undulations and wavelike motions are tuned and controlled by altering the amplitude, shape, and or duration of the electrical signals being applied. Initially, the actuator 30 is at a resting position such that the membrane 22 is substantially parallel to a bottom surface 40 of the cavity 34 and is substantially coplanar to an upper surface 42. In response to the application of the electric field $E_z$ across the thickness d of the piezoelectric element 24 from the upper electrode 28 to the lower electrode 26, the piezoelectric element 24 mechanically contracts. The mechanical contraction of the piezoelectric element 24 results in a deflection of membrane 22 in the direction of the cavity 34. The mechanical contraction and deflection produce a displacement Δz of the actuator 30 from the resting position toward the cavity 34. The membrane 22 has an initial length L, measured from one side of the cavity 34 to another. The mechanical contraction and deflection also produces a variation ΔL of the length L of the membrane so that the total length of the membrane 22 is L+ΔL from one side of the cavity to another while displacing a quantity of the volume of the cavity 34.

The volume of liquid expressed from the cavity 34 through the outlet port 38 is determined by the variation ΔL of the length L of the membrane 22. The variation ΔL is expressed as:

$$\Delta L=\alpha\times\Delta L_f$$

where:

$\Delta L_f=d_{31}\times E_z$, is the length variation of a free standing and unclamped piezoelectric layer of length L, α is a proportionality coefficient that takes into account the mechanical constraints of the clamped membrane, $d_{31}$ is the transverse direct piezoelectric coefficient of the piezoelectric element 24, and $$E_z=V/d,$$

where:

V is the amplitude of the electric pulse applied between the lower and upper electrodes 26, 28, and d is the thickness of the piezoelectric element 24.

Accordingly, the variation ΔL is proportional to the transverse direct piezoelectric coefficient $d_{31}$ multiplied by the transverse electric field $E_z$. According to one embodiment, the variation ΔL causes the membrane 22 to deflect or displace by a distance Δz from the resting position of the actuator 30. The distance Δz of displacement of the actuator 30 is a few tens of nanometers to a few hundreds of nanometers, according to one embodiment.

The displacement Δz multiplied by the area of the membrane 22 that is above the cavity 34 is approximately equal to the volume of the cavity 34 that is displaced or suctioned in when the actuator 30 is powered.

The volume of liquid expressed from the cavity 34 is adjustable by varying the amplitude V of the electric pulse applied to the actuator 30, according to one embodiment of the invention. Generally, the distance Δz of displacement of the actuator 30 is a function of the amplitude V of the electric pulse. Accordingly, increasing and decreasing the amplitude V of the electric pulse will correspondingly increase and decrease the extension ΔL of the membrane 22. According to one embodiment, the amplitude V of the electric pulse ranges between a few tens of volts to a few volts. As discussed above, the volume of liquid displaced from the cavity 24 is proportional to the extension ΔL, according to one embodiment.

The volume of liquid expressed from the cavity 34 is adjustable by varying the rate at which the amplitude V of the electric pulse is applied to the actuator 30, according to another embodiment of the invention. As discussed above, the volume of liquid contained within the cavity 34 is prevented from undesirably discharging from the outlet port 38 by the surface tension of the liquid at the outlet port 38. According to one embodiment, increasing the rate at which the membrane 22 displaces a volume of the liquid in the cavity 34 decreases the cohesion of the fluid molecules of the surface of the fluid at the outlet port 38, enabling a greater volume of fluid to be expressed from the cavity 34 than when the membrane 22 is displaced at a lower rate. Accordingly, the volume of liquid expressed from the cavity 34 is adjustable at a given amplitude V of the electric pulse by altering the rate at which the amplitude V of the electric pulse is applied to the actuator 30.

Figure 14:
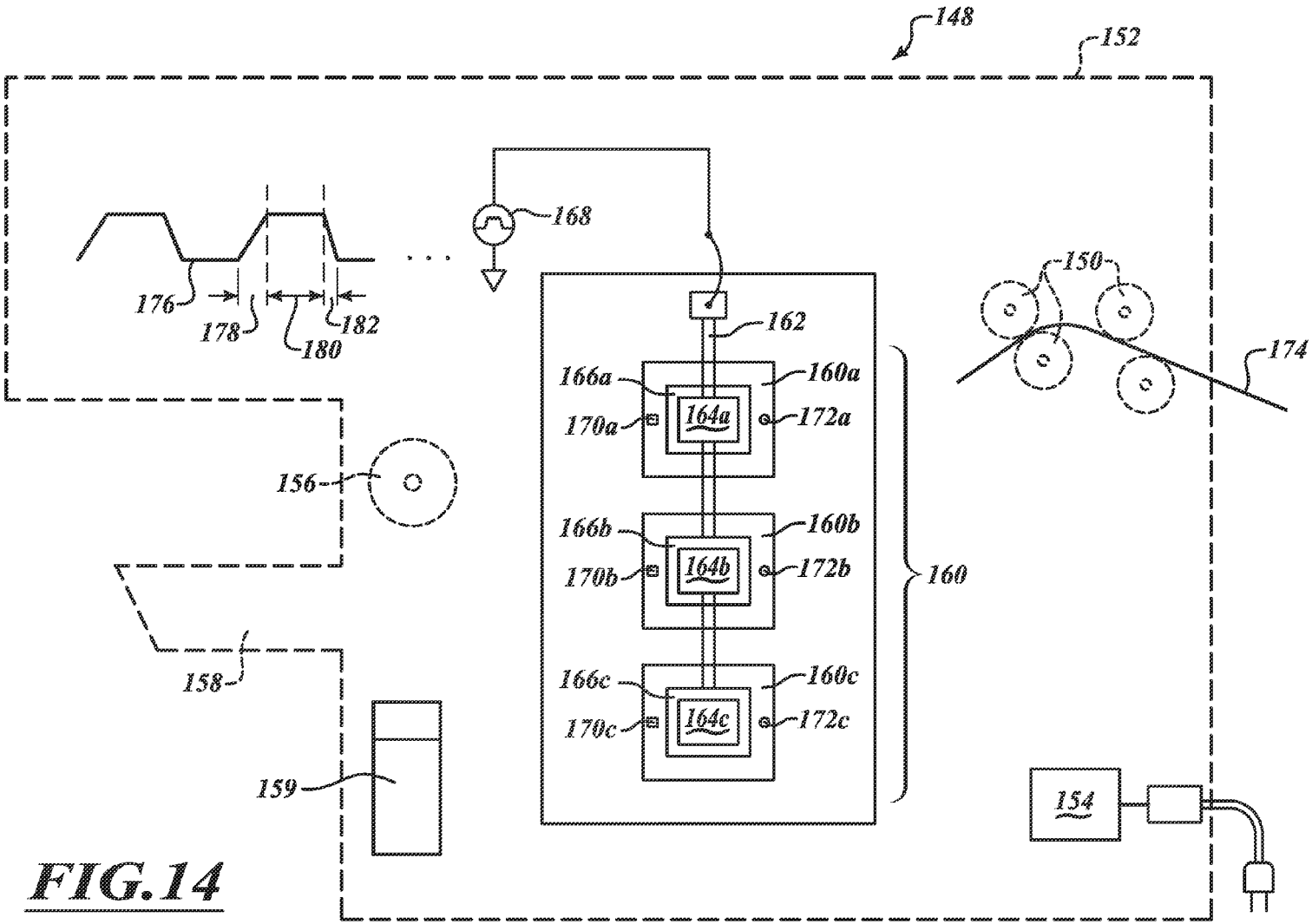
FIG. 14 is a top plan view of a printer having a plurality of microfluidic jetting devices actuated with an electrical pulse, according to an embodiment of the invention.

According to one embodiment, the shape of the electric pulse applied to the actuator 30 is trapezoidal (see FIG. 14). The trapezoidal electric pulse includes a rate of increasing voltage, a steady-state, and a rate of decreasing voltage. According to one embodiment the rate of decreasing voltage is much higher or faster than the rate of increasing voltage in order to cause the membrane 22 to mechanically overshoot its resting position as the electric field $E_z$ is removed from across the piezoelectric element 24. By causing the membrane 22 to mechanically overshoot its resting position, the actuator 30 creates a suction force at the inlet port 36, introducing additional liquid into the cavity 34. According to another embodiment, the trapezoidal electric pulse is symmetric so that the rate of increasing voltage is the negative of the rate of decreasing voltage. The first symmetric trapezoidal electric pulse is followed by a second symmetric trapezoidal electric pulse having a polarity that is opposite to the first symmetric trapezoidal electric pulse. By applying a positive electric pulse followed by a negative electric pulse to the actuator 30, the contraction or deformation of the piezoelectric element 24 causes a deflection or displacement of the membrane 22 in a direction away from the cavity 34, creating a suction force at the inlet port 36 that facilitates the flow of liquid into the cavity 34 to replace the volume of liquid expressed or jetted from the outlet port 38.

The displacement of the membrane 22 is tuned by sizing the area of the lower electrode 26 and the area of the upper electrode 28 to control the mechanical contraction of the piezoelectric element 24, according to one embodiment of the invention. The lower electrode 26 spans a portion of the base of the piezoelectric element 24 so that the upper electrode 28 has a greater surface area than the lower electrode 26. According to another embodiment, the lower electrode 26' is at least as wide as the width of the base of the piezoelectric element 24, and the lower electrode 26' has a greater surface area than the upper electrode 28.

Advantageously, the inlet port 36 and the outlet port 38 are opened through the membrane 22 which is displaced to force liquid in the inlet port 36 and out of the outlet port 38. Having both the inlet port 36 and the outlet port 38 opened through the membrane 22 simplifies the manufacturing process by allowing the ports 36, 38 to be opened during the same manufacturing process step, according to one embodiment. Additionally, opening the outlet port 38 through the membrane 22 provides the advantage of enabling the actuator to be oriented in the same direction as liquid ejection from the outlet port 38.

In general, a mechanical fluid actuator, such as the one described in FIG. 1 and subsequent Figures, is easier to operate and adjust to the type of fluid being ejected from the outlet port 38, than thermally operated jetting devices. For example, a thermally operated jetting device must take into account coefficients of thermal expansion and contraction of the liquid being ejected. Furthermore, the thermally operated jetting device must include circuitry to measure and adjust the temperature of the liquid in order to compensate for changes in ambient temperatures of surrounding circuits and systems. In contrast, a mechanical fluid actuator is relatively robust to temperature changes occurring in the liquid being ejected due to increases in ambient or surrounding temperatures caused by operation of a system of which the mechanical fluid actuator is a part.

FIGS. 2-7 illustrate various stages in a method of manufacturing a microfluidic jetting device in accordance with several embodiments of the invention.

Figure 2:
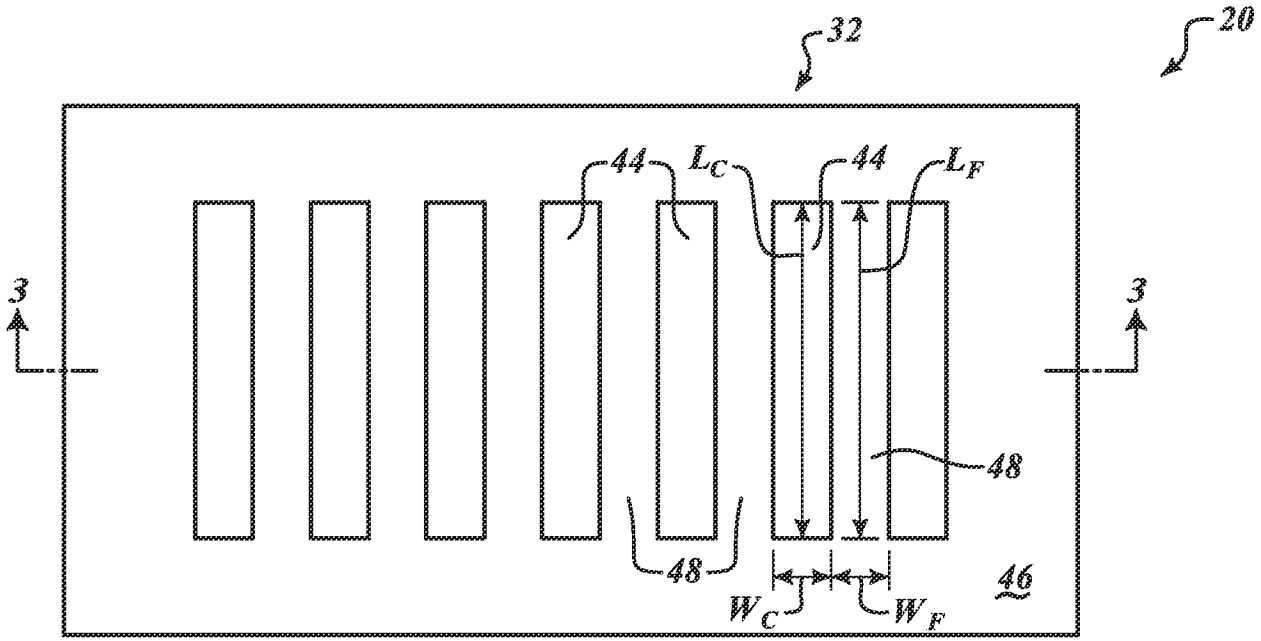
FIG. 2 is a top plan view illustrating the application of an etch to form channels in a substrate as part of forming the microfluidic jetting device of FIG. 1, according to an embodiment of the invention.

FIG. 2 is a top plan view of a microfluidic jetting device 20 illustrating the formation of a plurality of channels 44 in the substrate 32, during the manufacturing process. The plurality of channels 44 are formed by first depositing a layer of photoresist, patterning and developing the layer of photoresist, removing the developed portions of the layer of photoresist, and etching through a hard mask 46 that has been deposited over the substrate 32. Subsequently, the layer of photoresist is removed and an etch that is selective to silicon is applied, resulting in each of the plurality of channels 44 will having a width $W_C$ and a length $L_C$. The formation of the plurality of channels 44 also results in the formation of a plurality of fingers 48. Each of the plurality of fingers 48 includes a length $L_F$ and a width $W_F$. The length $L_C$ of the plurality of channels 44 and the length $L_F$ of the plurality of fingers 48 is a few tens to a few hundreds of micrometers, according to one embodiment. The channels can also be in the submicron range, for example, in the range of 100-400 nanometers if desired. According to another embodiment, the widths $W_C$ of the plurality of channels 44 is substantially narrower than the widths $W_F$ of the plurality of fingers 48.

Figure 3:
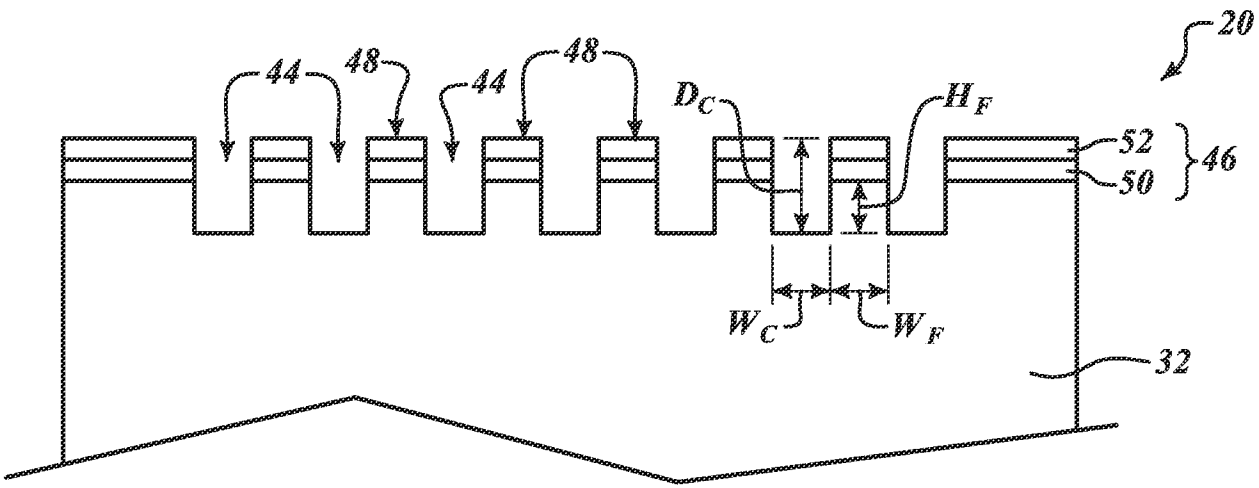
FIG. 3 is a schematic cross-sectional view of the microfluidic jetting device of FIG. 2, according to an embodiment of the invention.

FIG. 3 is a cross-sectional view along line 3-3 of the microfluidic jetting device 20 illustrated in FIG. 2, during the manufacturing process. As illustrated, the hard mask 46 includes an oxide layer 50 grown or deposited over the substrate 32 and includes a dielectric layer 52 deposited over the oxide layer 50. The dielectric layer 52 is silicon nitride deposited via chemical vapor deposition (CVD), according to one embodiment. As will be discussed in more detail below, the height $H_F$ of each of the plurality of fingers 48 at least partially determines an overall thickness of the membrane 22, according to one embodiment.

Figure 4:
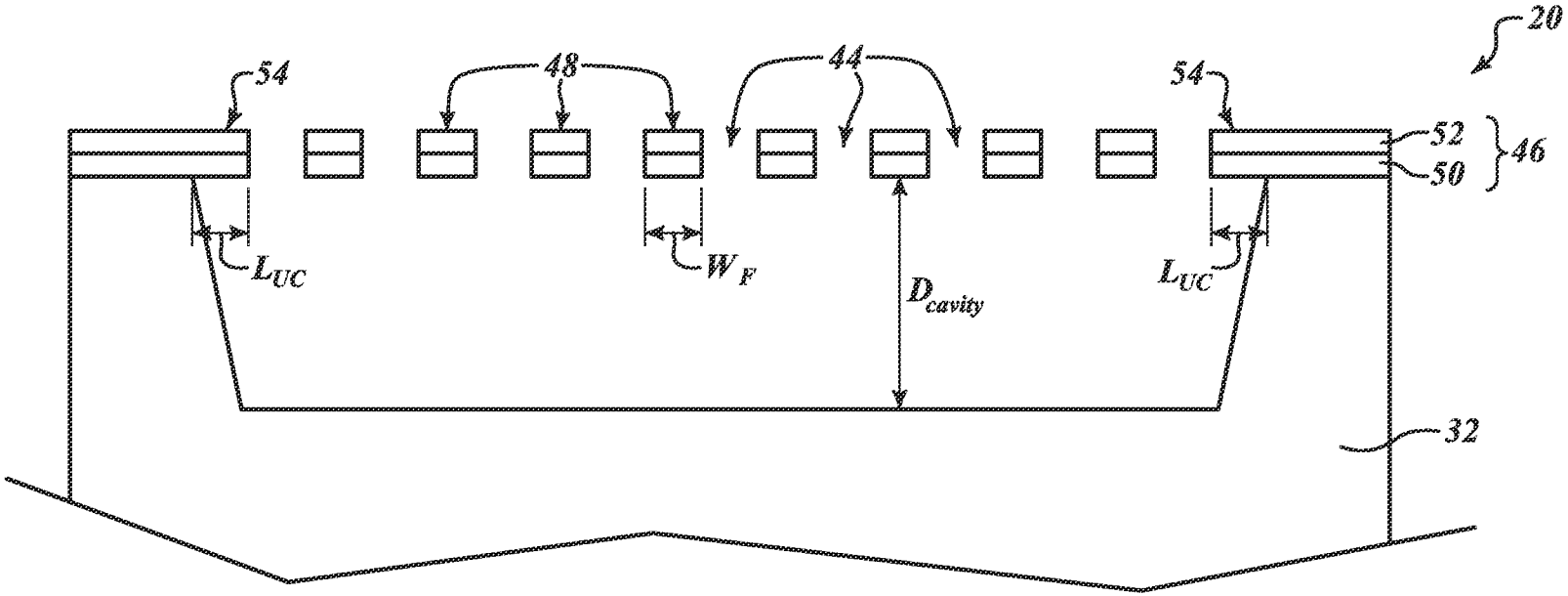
FIG. 4 is a schematic cross-sectional view illustrating the application of an isotropic etch to the microfluidic jetting device of FIG. 2 to form a cavity, according to an embodiment of the invention.

FIG. 4 is a cross-sectional view of the microfluidic jetting device 20 of FIG. 3 and illustrates the formation of the cavity 34, during the manufacturing process. An isotropic etch is applied through the pattern defined by the hard mask 46 to the microfluidic jetting device 20. The isotropic etch removes portions of the substrate 32 that are beneath the plurality of fingers 48 of the hard mask 46 to define a depth $D_{cavity}$ of the cavity 34. The depth $D_{cavity}$ of the cavity 34 is determined, in part, by the duration of the isotropic etch an in part by the depth $D_c$ of the plurality of channels 44. The depth $D_{cavity}$ of the cavity 34 is a few tens of micrometers to a few hundreds of micrometers, according to one embodiment. The isotropic etch also undercuts perimeter portions 54 of the oxide layer 50 by a length $L_{UC}$, so that a portion of the oxide layer 50 is suspended over the cavity 34. The width $W_F$ of each of the plurality of fingers ranges from hundreds of nanometers to tens of micrometers, according to one embodiment. The thickness of the oxide layer 50 is tens of nanometers to hundreds of nanometers, according to another embodiment.

Figure 5:
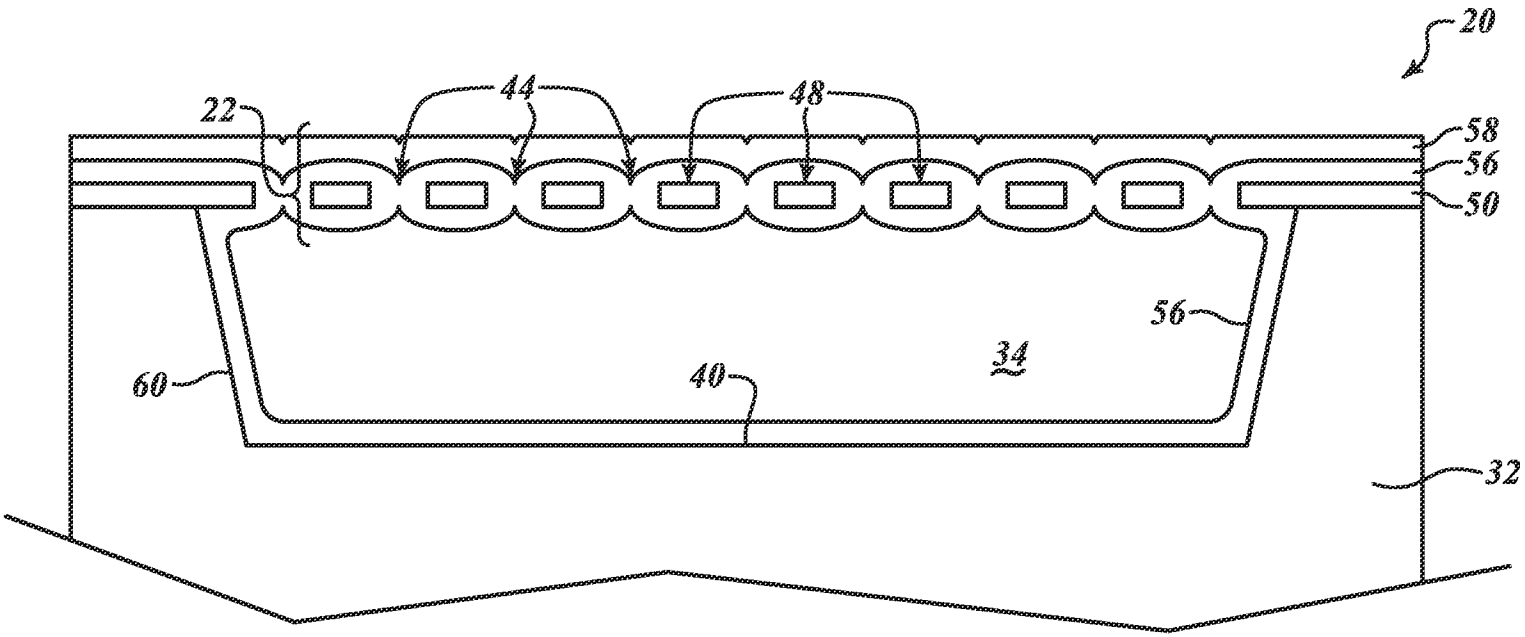
FIG. 5 is a schematic cross-sectional view illustrating the deposition of a dielectric layer to form a membrane of the microfluidic jetting device of FIG. 4, according to an embodiment of the invention.

FIG. 5 is a cross-sectional view of the microfluidic jetting device 20 of FIG. 4 and illustrates the formation of the membrane 22, during the manufacturing process. Initially, the dielectric layer 52 of the hard mask 46 is removed from the surface of the oxide layer 50, for example, by an anisotropic etch. Then a layer 56, such as silicon nitride, is deposited to surround the plurality of fingers 48 of the oxide layer 50. The layer 56 may be a dielectric layer, such as a silicon nitride, or it can be a layer of very high resistivity, such as intrinsic polysilicon, which is so resistive as to be considered an insulator in the undoped state The layer 56 is deposited by a CVD process which is continued until spaces between the plurality of fingers 48 are filled with silicon nitride. As illustrated, the deposition of the layer 56 results in both the top, bottoms, and sides of the plurality of fingers 48 being enclosed with the layer 56, so that the membrane 22 has continuous length L (shown in FIG. 1) across the cavity 34. Optionally, the membrane 22 includes a layer of polysilicon 58 deposited over a dielectric layer 56.

During the layer 56 deposition, the layer 56 also covers surfaces of the substrate 32 are defined by the walls 60 and the bottom 40 of the cavity 34. Because monosilicon and some dielectrics, such as silicon nitride, have poor interface properties, a layer of thermal oxide is grown on the walls 60 and bottom 40 of the cavity 34 to improve the adhesion of the layer 56 that is deposited within the cavity 34. The resulting membrane 22 is hundreds of nanometers to a few micrometers thick and hundreds of micrometers to a few millimeters long.

Figure 6:
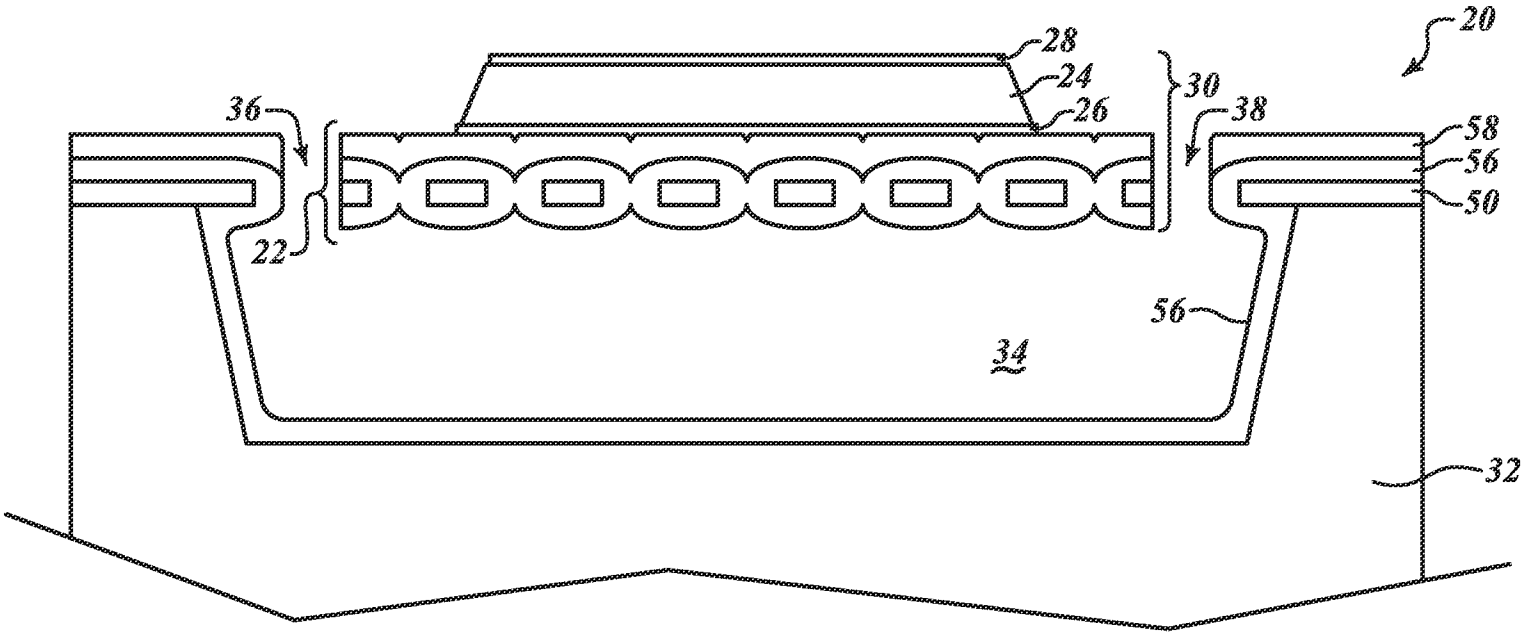
FIG. 6 is a schematic cross-sectional view illustrating the addition of piezoelectric element above the membrane of the microfluidic device of FIG. 5, according to one embodiment of the invention.

FIG. 6 is a cross-sectional view of the microfluidic jetting device 20 of FIG. 5 and illustrates the formation of the remainder of the actuator 30, according to one embodiment. As discussed above in connection with FIG. 1, the actuator 30 includes the membrane 22, the lower electrode 26, the piezoelectric element 24, and the upper electrode 28.

The lower electrode 26 and the upper electrode 28 are deposited as thin film layers. Upon completion of the formation of the membrane 22, one or more layers of resist are used to pattern or define the shape of the lower electrode 26. The lower electrode 26 is deposited using CVD and is a silicide layer that is titanium silicide, tungsten silicide, or the like, according to one embodiment. While the use of a silicide is specified, it is within the scope of embodiments of the invention to use other thin-film conductive layers, such as platinum, tungsten, or other metal for the lower electrode 26 and the upper electrode 28.

The piezoelectric element 24 is deposited above the lower electrode 26. The piezoelectric element 24 is a piezoelectric ceramic layer, such as PZT (lead zirconate titanate). The piezoelectric element 24 is deposited with a sol-gel spin coat, sputtering, CVD, or the like. After the deposition of the piezoelectric element 24, thermal treatments are applied to the microfluidic jetting device 20 to produce a perovskite ceramic characteristic of the piezoelectric element 24 to enhance the piezoelectric effects of the actuator 30.

The upper electrode 28 is deposited in a manner described above for the lower electrode 26 after the formation of the piezoelectric element 24, according to one embodiment of the invention.

The inlet port 36 and the outlet port 38 are opened in the membrane 22 after the deposition of the upper electrode 28, according to one embodiment of the invention. According to another embodiment, the inlet port 36 and the outlet port 38 are opened in the membrane 22 before the deposition of the lower electrode 26. The inlet and outlet ports 36, 38 are opened using techniques known to those of ordinary skill in the art. For example, the inlet and outlet ports 36, 38 are opened by depositing a layer of photoresist, developing the photoresist to the approximate shape and size of the inlet and outlet ports 36, 38, and then applying an anisotropic etch to the openings in the photoresist to open the inlet and outlet ports 36, 38 through the membrane 22.

Figure 7:
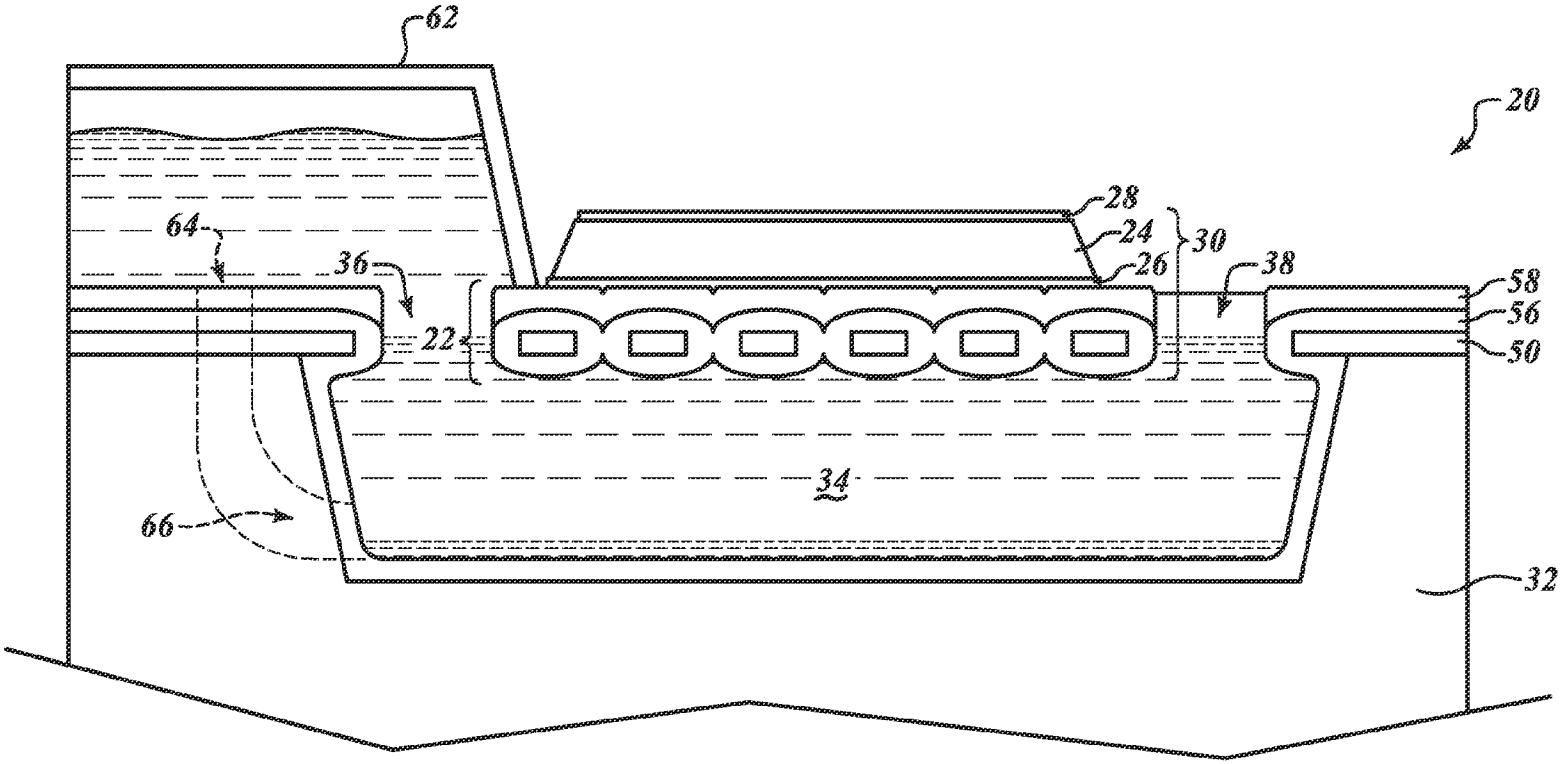
FIG. 7 is a schematic cross-sectional view of the addition of a fluid reservoir to the microfluidic jetting device of FIG. 6, according to one embodiment of the invention.

FIG. 7 is a cross-sectional view of the microfluidic jetting device 20 of FIG. 6 illustrated with the addition of a reservoir 62. The reservoir 62 is communicatively coupled to the inlet port 36 to supply a quantity of liquid into the cavity 34. The reservoir 62 is disposed at least partially over the membrane 22. The reservoir 62 is formed using techniques similar to those described above in connection with the formation of the membrane 22, according to one embodiment of the invention. According to another embodiment, the inlet port 36 is opened under the surface 64 and is communicatively coupled to the cavity 34 through a channel 66, so that neither the inlet port 36 nor the reservoir 62 inhibit the operation of the actuator 30.

FIGS. 8-11 illustrate various stages in a method of manufacturing a microfluidic jetting device 70 in accordance with several embodiments of the invention.

Figure 8:
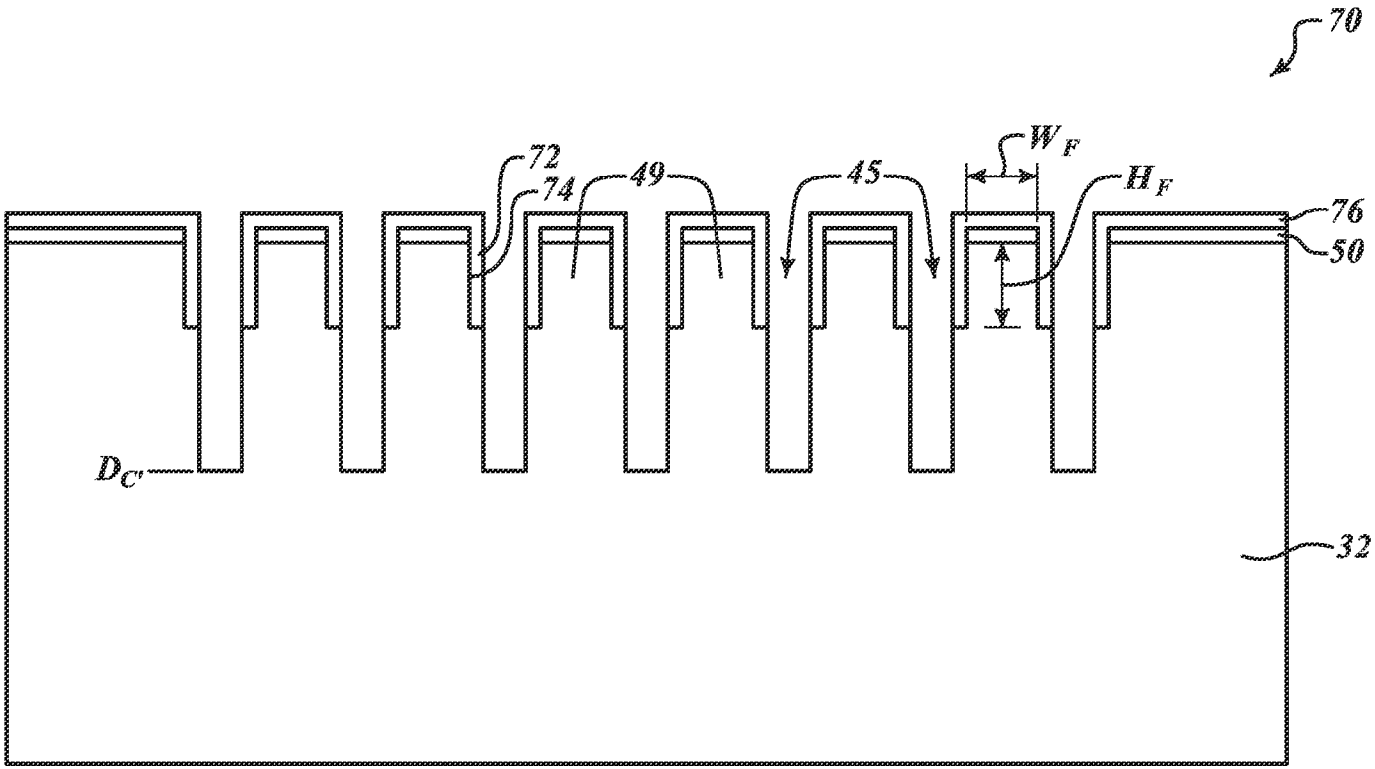
FIG. 8 is a schematic cross-sectional view illustrating the application of an anisotropic etch to the microfluidic jetting device of FIG. 3, according to another embodiment of the invention.

FIG. 8 is a cross-sectional view of the microfluidic jetting device 70 that is based on the cross-sectional view of the microfluidic jetting device of FIG. 3, during the manufacturing process. After a plurality of channels 45 and the plurality of fingers of monosilicon 49 are formed a dielectric layer 72 is deposited over at the plurality of fingers of monosilicon 49 and in the plurality of channels 45.

An anisotropic etch is performed to increase the depth of the plurality of channels 45 to a depth $D_C'$. During the anisotropic etch portions of the dielectric layer 72 are removed so that the dielectric layer 72 lines the side walls 74 of the plurality of channels 45 and a dielectric layer 76 remains above the oxide layer 50. According to one embodiment, the dielectric layer 72 and the dielectric layer 76 are silicon nitride.

Figure 9:
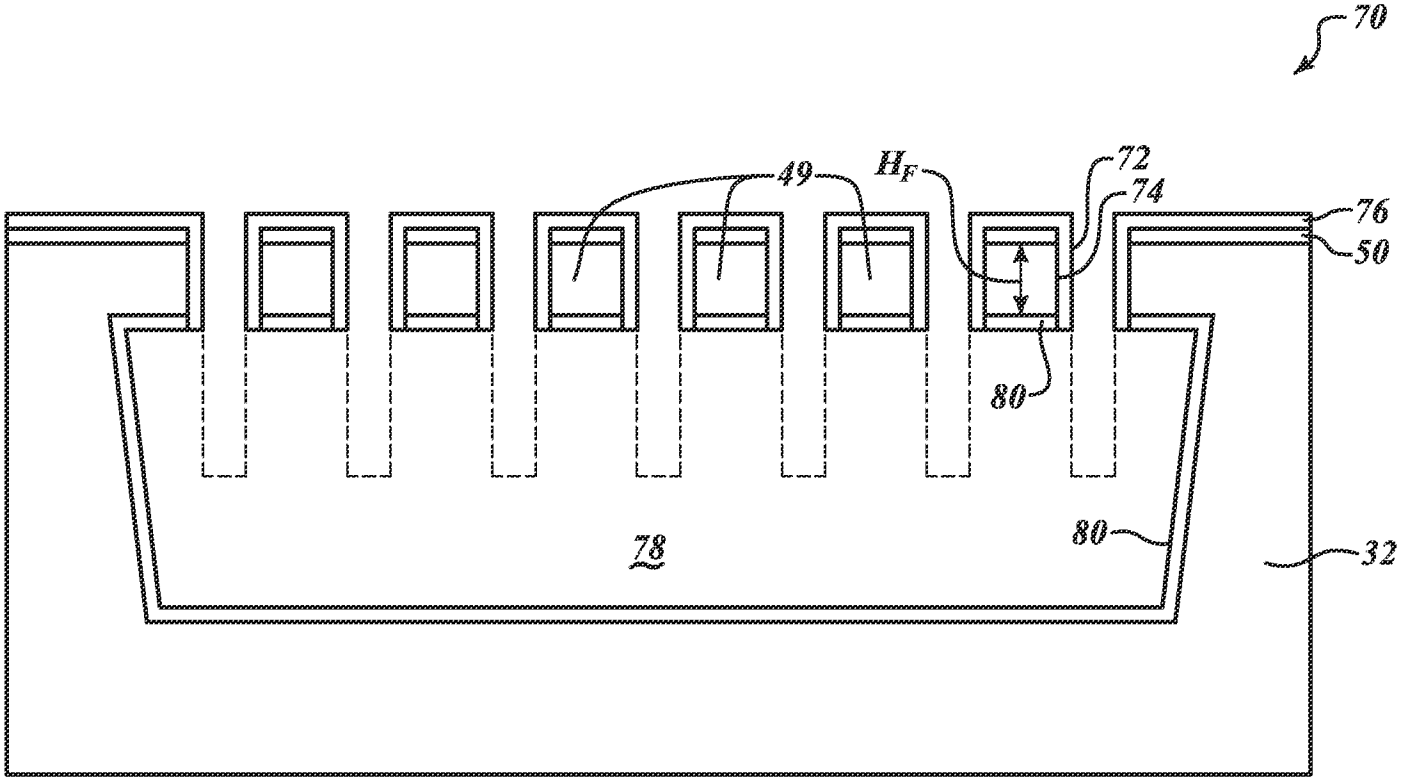
FIG. 9 is a schematic cross-sectional view of the application of an isotropic etch to form a cavity of the microfluidic jetting device of FIG. 8, according to an embodiment of the invention.

FIG. 9 is a cross-sectional view of the microfluidic jetting device 70 of FIG. 8 and illustrates the formation of a cavity 78, during the manufacturing process. The cavity 78 is formed by applying an isotropic etch for a duration of time sufficient to remove the silicon from below the plurality of fingers of monosilicon 49. An oxide layer 80 is grown or deposited on the exposed silicon in preparation for the process steps illustrated in FIG. 10. Accordingly, the thickness $H_F$ of the plurality of fingers of monosilicon 49 that was defined while etching the plurality of channels 45 determines a minimal thickness of the subsequently formed membrane.

Figure 10:
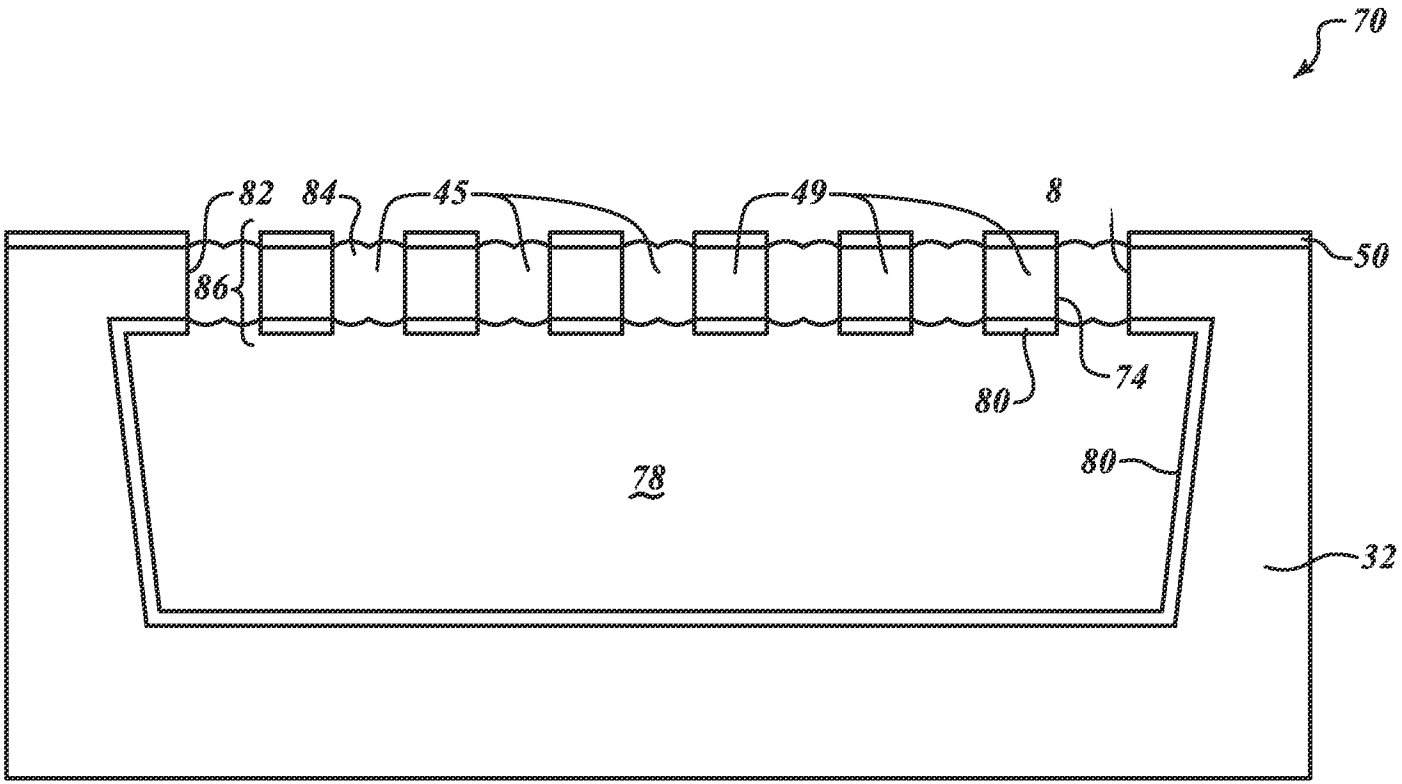
FIG. 10 is a schematic cross-sectional view illustrating the growth of epitaxial monosilicon to enclose the cavity of the microfluidic jetting device of FIG. 9 with a membrane, according to an embodiment of the invention.

FIG. 10 is a cross-sectional view of the microfluidic jetting device 70 of FIG. 9 further illustrating the growth of an epitaxial layer, during the manufacturing process. Initially, the dielectric layers 72, 76 are removed with a selective etch to expose sidewalls 82 and the side walls 74 of the plurality of fingers of monosilicon 49. Next, an epitaxial layer 84 is grown to fill the plurality of spaces 45 that are between the plurality of fingers of monosilicon 49. Accordingly the top of the cavity 78 is enclosed by a membrane 86 which includes the plurality of fingers 49 laterally connected with the epitaxial layer 84. The oxide layer 80 that was grown or deposited within the cavity 78 inhibits the growth of epitaxial layer 84 on the walls and the floor of the cavity 78 and thus preserves the dimensions of the cavity 78 during the growth of the epitaxial layer 84.

Figure 11:
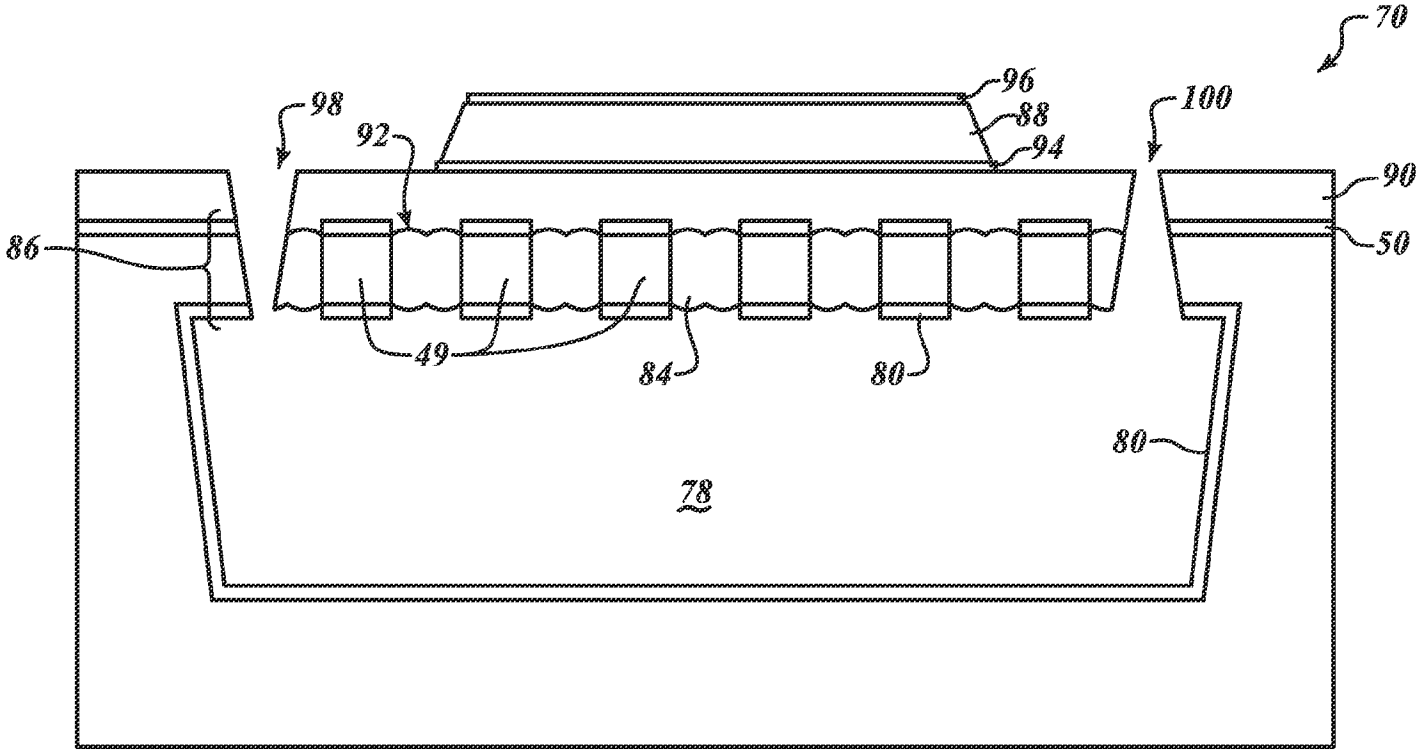
FIG. 11 is a schematic cross-sectional view illustrating the addition of a piezoelectric element to the microfluidic jetting device of FIG. 10, according to an embodiment of the invention.

FIG. 11 is a cross-sectional view of the microfluidic jetting device 70 of FIG. 10 and illustrates the formation of a piezoelectric element 88. After formation of the membrane 86, a conformal layer 90 is optionally deposited over the membrane 86 to provide a surface adequate to receive subsequent layers, according to one embodiment. According to another embodiment, an upper surface 92 of the membrane 86 is polished smooth, using a process such as a chemical mechanical polish in preparation for the deposition of subsequent layers. The piezoelectric element 88, a lower electrode 94, and an upper electrode 96 are each deposited using techniques described above in accordance with FIG. 6.

An inlet port 98 and an outlet port 100 are opened through the membrane 86 using the techniques described above, according to several embodiments of the invention. With respect to the inside of the cavity 78, the inlet port 98 is shaped as divergent nozzle, and liquid supplied to the cavity 78 through the inlet port 98 is pressurized. With respect to the inside of the cavity 78, the outlet port 100 is shaped as a convergent nozzle to increase the pressure of the volume of liquid to be ejected from the cavity 78 through the outlet port 100.

Figure 12:
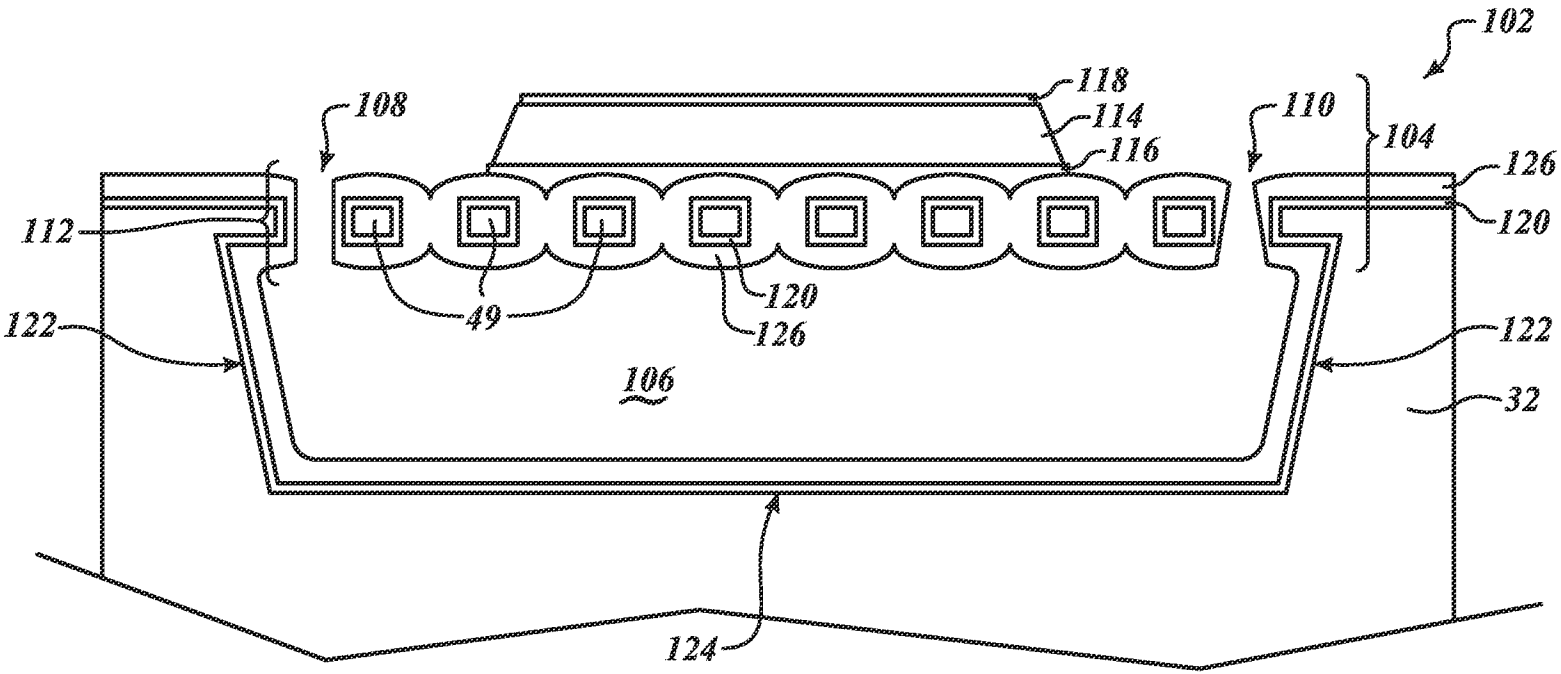
FIG. 12 is a schematic cross-sectional view illustrating the growth of silicon nitride around silicon dioxide to enclose the cavity of the microfluidic jetting device of FIG. 9 with a membrane, according to an embodiment of the invention.

FIG. 12 is a cross-sectional view of a microfluidic jetting device 102 manufactured in accordance with another embodiment of the invention. The microfluidic jetting device 102 includes an actuator 104, a cavity 106, an inlet port 108, and an outlet port 110.

The actuator 104 includes a membrane 112, a piezoelectric element 114, a lower electrode 116, and an upper electrode 118. The membrane 112 includes a plurality of fingers of monosilicon 49. The plurality of fingers of monosilicon 49 are surrounded or enclosed by a first dielectric layer 120. The first dielectric layer 120 is thermally grown or is deposited, according to various embodiments of the invention. The first dielectric layer 120 is also grown on walls 122 and a bottom 124 of the cavity 106. A second dielectric layer 126 is subsequently formed over the first dielectric layer 120. The second dielectric layer 126 is deposited until each of the plurality of fingers of monosilicon 49 are laterally joined together as a single composite structure of the membrane 112. According to one embodiment, the first dielectric layer 120 is an oxide layer that is thermally grown or deposited with a manufacturing process such as CVD. According to another embodiment, the second dielectric layer 126 is a silicon nitride layer that is deposited using CVD, sputtering, or the like.

The actuator 104 includes the piezoelectric element 114, the lower electrode 116, and the upper electrode 118 deposited above the membrane 112 using techniques described above in connection with previously disclosed Figures, according to several embodiments of the invention.

The cavity 106, the inlet port 108, and the output port 110 are opened using techniques described above in connection with previously disclosed Figures, according to several embodiments of the invention.

Figure 13:
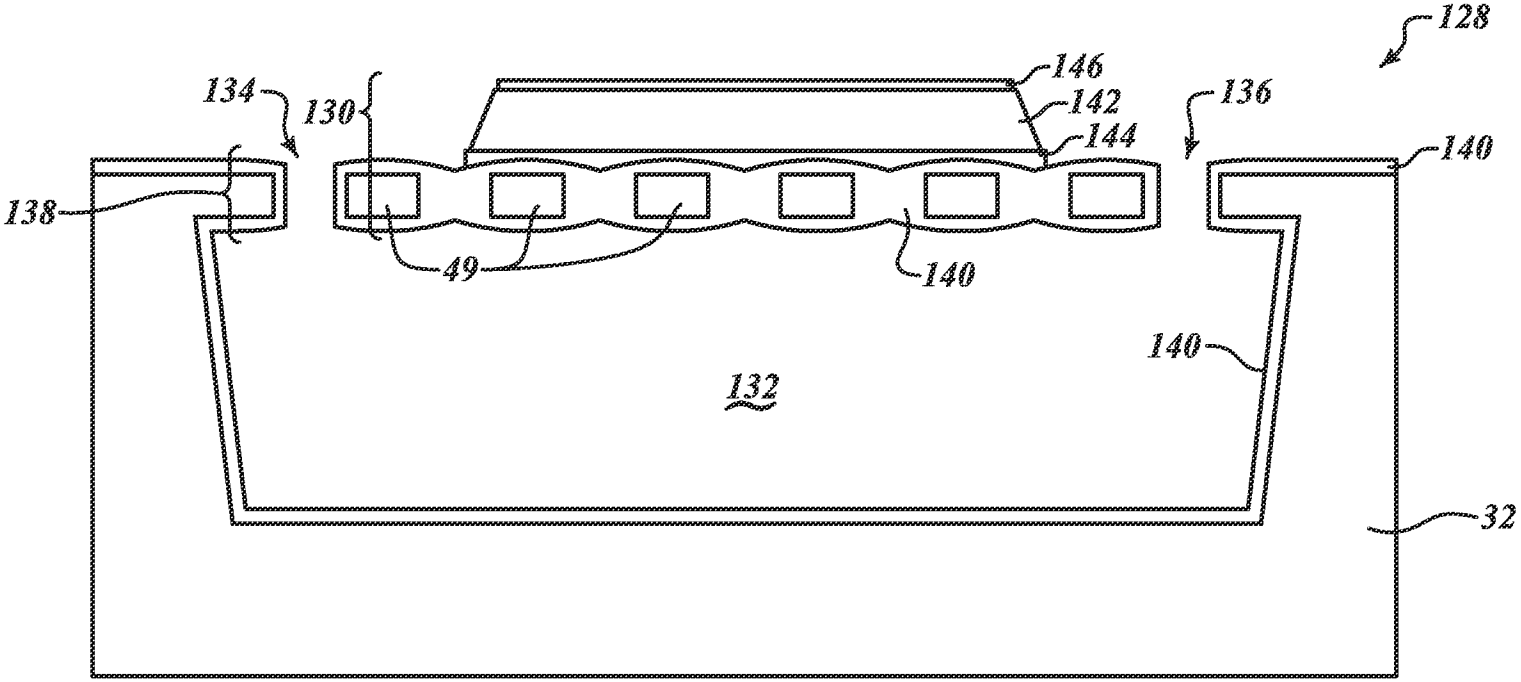
FIG. 13 is a schematic cross-sectional view illustrating the growth of epitaxial monosilicon to enclose the cavity of the microfluidic jetting device of FIG. 9 with a membrane, according to an embodiment of the invention.

FIG. 13 is a cross-sectional view of a microfluidic jetting device 128 manufactured in accordance with another embodiment of the invention. The microfluidic jetting device 128 includes an actuator 130, a cavity 132, an inlet port 134, and an outlet port 136.

The actuator 130 includes a membrane 138. The membrane 138 is formed by growing an epitaxial layer 140 around the plurality of fingers 49 of monosilicon. The epitaxial layer 140 is grown until the plurality of fingers 49 of monosilicon are joined together, making the membrane 138 a single structure expanding across the length L (shown in FIG. 1) of the cavity 132. The actuator 130 also includes a piezoelectric member 142 disposed between the lower electrode 144 and an upper electrode 146 according to the techniques described above.

The cavity 132, the inlet port 134, and the outlet port 136 are opened using techniques described above in connection with previously disclosed Figures, according to several embodiments of the invention.

FIG. 14 is a top plan view of a plurality of microfluidic jetting devices that are part of a printer 148. The printer 148 includes a housing 152, a plurality of input rollers 150, a power supply 154, one or more output rollers 156, an output tray 158, an ink reservoir 159, and a plurality of microfluidic jetting devices 160.

The plurality of microfluidic jetting devices 160 are represented by individual microfluidic jetting devices 160*a*, 160*b*, 160*c*. The plurality of microfluidic jetting devices 160 include tens, hundreds, or thousands of devices similar to the illustrated microfluidic jetting devices 160*a*, 160*b*, 160*c*, according to several embodiments of the invention. Each of the plurality of microfluidic jetting devices 160 is manufactured according to one or more of the embodiments disclosed herein in connection with FIGS. 1-13.

The plurality of microfluidic jetting devices 160 are electrically coupled or connected together with a conductive member 162. The conductive member 162 is a trace that connects an electrode 164 of each of the actuators 166 to an electric signal generator 168. The electric signal generator 168 is configured to generate a plurality of pulses 176 or sinusoidal signals that cause each of the plurality of actuators 166 to suction ink, e.g., from the ink reservoir 159, into a plurality of input ports 170 and eject ink from a plurality of output ports 172. As described in connection with FIG. 1, each of the plurality of pulses 176 is trapezoidal having a rate of increasing amplitude 178, at least one steady-state amplitude 180, and a rate of decreasing amplitude 182, according to one embodiment. The rate of increasing amplitude 178 is slower than the rate of decreasing amplitude 182 in order to precisely control the ejection of liquid from the outlet port 172. The rate of decreasing amplitude 182 faster or steeper than the rate of increasing amplitude to allow the membranes of the plurality of actuators 166 to whip past and overshoot a resting position of the membranes in order to create suction within the cavities of the jetting devices 160 at the plurality of inlet ports 170.

The printer 148 operates by receiving one or more pieces of paper 174 through the plurality of input rollers 150. The input rollers, or some other intermediate mechanism, causes the paper 174 to pass proximate to the plurality of microfluidic jetting devices 160. The plurality of microfluidic jetting devices 160 eject ink from the plurality of outlet ports 172 on to the paper 174, in response to the plurality of pulses 176 generated by the signal generator 168, which are generated to cause the plurality of actuators 166 to displace the ink carried within the plurality of microfluidic jetting devices 160. The paper 174 is subsequently guided to the one or more output rollers 156, which propel(s) the paper 174 on to the output tray 158.

The above description of illustrated embodiments, including what is described in the Abstract, is not intended to be exhaustive or to limit the embodiments to the precise forms disclosed. Although specific embodiments and examples are described herein for illustrative purposes, various equivalent modifications can be made without departing from the spirit and scope of the disclosure, as will be recognized by those skilled in the relevant art.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety, including: U.S. Pat. Nos. 6,294,860; 6,673,593; 6,693,039; 6,770,471; 7,678,600; 7,705,416; 7,754,578; and 7,811,848 in addition to foreign publications JP2003133604 and JP10287268. Aspects of the embodiments can be modified, if necessary to employ concepts of the various patents, applications and publications to provide yet further embodiments.

I claim:

1. A liquid displacement apparatus, comprising:

a silicon substrate;

a cavity formed in the substrate;

a membrane having a first portion that is positioned over the cavity and a second portion that is anchored to the substrate around a perimeter of the cavity, the first portion being flexibly suspended over the cavity to at least partially enclose the cavity;

a piezoelectric element positioned over the first portion and operable to displace the first portion into and out of the cavity;

a lower electrode disposed over the membrane with at least part of the lower electrode being disposed between the first portion and the piezoelectric element;

an upper electrode disposed at least partially over the piezoelectric element; and an outlet aperture positioned adjacent the first portion and configured to output a volume of the liquid through the aperture from the cavity in response to the first portion being displaced.

2. The apparatus of claim 1, further comprising an inlet aperture positioned adjacent the first portion.

3. The apparatus of claim 2 wherein the inlet aperture is positioned in the membrane at a first location between the piezoelectric element and a first side of the cavity, the outlet aperture being positioned in the membrane at a second location between the piezoelectric element and a second side of the cavity.

4. The apparatus of claim 3 wherein the first side of the cavity is opposite from the second side of the cavity such that the inlet aperture and the outlet aperture are on opposite sides of the piezoelectric element.

5. The apparatus of claim 3 wherein the cavity is substantially polygonal and the first side of the cavity is adjacent to the second side of the cavity.

6. The apparatus of claim 2 wherein the inlet aperture and the outlet aperture are both positioned between a first side of the piezoelectric element and a first edge of the cavity.

7. The apparatus of claim 2 wherein the inlet aperture has a larger area than the outlet aperture.

8. The apparatus of claim 2 wherein the inlet aperture is shaped polygonal.

9. The apparatus of claim 8 wherein the outlet aperture is shaped henagonal.

10. The apparatus of claim 2, further comprising a reservoir configured to supply a liquid to the cavity, the reservoir having an inner compartment that is communicably coupled to the cavity through the inlet aperture.

11. A printer, comprising:

a plurality of rollers to guide a printable medium into and out of the printer;

an ink reservoir to hold a first quantity of ink;

a liquid displacement apparatus of that is configured to apply ink to the printable medium the liquid displacement apparatus comprising:

a silicon substrate;

a cavity formed in the substrate;

a membrane having a first portion that is positioned over the cavity and a second portion that is anchored to the substrate around a perimeter of the cavity, the first portion being flexibly suspended over the cavity to at least partially enclose the cavity;

a piezoelectric element positioned over the first portion and operable to displace the first portion into and out of the cavity;

a lower electrode disposed over the membrane with at least part of the lower electrode being disposed between the first portion and the piezoelectric element an upper electrode disposed at least partially over the piezoelectric element and an outlet aperture positioned adjacent the first portion and configured to output a volume of the ink through the aperture from the cavity in response to the first portion being displaced; and an electrical signal generator electrically coupled to the upper and lower electrodes and configured to selectively generate an electric field across the piezoelectric element.

12. The printer of claim 11 wherein the ink reservoir is configured to prevent ink from flowing into the ink reservoir from the cavity while the membrane displaces the volume of the third quantity of ink from the cavity.

13. The printer of claim 11 wherein the membrane includes monocrystalline silicon, silicon oxide, and silicon nitride.

* * * * *